US005924861A

United States Patent [19]

Rinker et al.

[11] Patent Number: 5,924,861

[45] Date of Patent: Jul. 20, 1999

[54] FURNACE DISCHARGE ASSEMBLY

[75] Inventors: Franklin G. Rinker, Perrysburg; William L. Thome, Maumee, both of Ohio

[73] Assignee: Maumee Research & Engineering, Incorporated, Maumee, Ohio

[21] Appl. No.: 08/919,399

[22] Filed: Aug. 28, 1997

[51] Int. Cl.[6] ..... F27B 9/39; F27B 7/33

[52] U.S. Cl. ..... 432/139; 432/117

[58] Field of Search ..... 432/103, 113, 432/117, 138, 139, 116; 110/246

[56] References Cited

U.S. PATENT DOCUMENTS

| | | | |
|---|---|---|---|
| 2,898,099 | 8/1959 | Coriolis | 432/113 |
| 3,142,546 | 7/1964 | Coats | 432/117 |
| 3,443,931 | 5/1969 | Beggs et al. | 75/33 |
| 4,259,060 | 3/1981 | Korzeb et al. | 432/117 |
| 4,631,026 | 12/1986 | McKinney | 432/138 |
| 4,636,127 | 1/1987 | Olano et al. | 414/158 |
| 4,870,911 | 10/1989 | Chang et al. | 110/246 |
| 5,562,053 | 10/1996 | Lim | 110/246 |

*Primary Examiner*—Teresa Walberg
*Assistant Examiner*—Gregory A. Wilson
*Attorney, Agent, or Firm*—MacMillan, Sobanski & Todd, LLC

[57] ABSTRACT

A discharge assembly for removing material from a hearth in a rotary hearth furnace. The discharge assembly includes, in combination, a discharge auger and a fluid cooled hood. The discharge auger is positioned above the hearth of the rotary hearth furnace and includes a central shaft having at least one helical flight affixed to the exterior of the central shaft. The fluid cooled hood is disposed over the discharge auger to lower the temperature of the helical flights.

20 Claims, 4 Drawing Sheets

FURNACE DISCHARGE ASSEMBLY

FIELD OF THE INVENTION

The present invention relates to a furnace discharge assembly. More particularly, the present invention relates to a furnace discharge assembly including a discharge auger and a fluid cooled hood disposed over the discharge auger which is positioned above a hearth in a rotary hearth furnace.

BACKGROUND OF THE INVENTION

Direct reduction of iron oxide and other metallic oxides may be conducted in rotary hearth furnaces ("RHF") using pelletized or briquetted feed deposited upon a rotating hearth. Briefly, a RHF is a continuous reheating furnace generally having an annular inner wall circumscribed by a spaced annular outer wall. The space there between includes a circular rotating hearth. Burners may be installed in the inner and outer walls and in the roof Gases from the furnace are permitted to vent through a flue located in the roof.

Material is usually loaded (dropped) onto the rotating hearth by a conveyor or chute. After the material is conveyed along the hearth path it is removed by a discharge auger. A discharge auger typically consists of a central shaft with solid helical metal flights welded thereto projecting away from the central shaft.

Due to the corrosive nature of the gases and materials present within the RHF, coupled with the high temperatures therein, the discharge auger is susceptible to frequent failure. In particular, because of the harsh environment within the furnace the metal flights generally deteriorate. High temperatures and the presence of oxygen or one or more of sodium, sulfides, chlorides, fluorides, potassium, lead, zinc, tin, iron, nickel and chromium within the RHF oftentimes corrodes and erodes the auger and renders the auger ineffective.

To lessen the effects of the high temperatures (1300°–2300° F.)(704°–1260° C.) involved, a cooling fluid is frequently passed through the auger. See U.S. Pat. Nos. 3,443,931 and 4,636,127, incorporated herein by reference. It is intended that with sufficient flow rate, the fluid cooling maintains the central shaft of the auger within safe operating temperatures. However, it will be appreciated that the helical tight of the discharge auger also receives considerable heat from both the furnace and the material in the furnace. Although some heat is conducted through the helical flight to the fluid cooled central shaft, the high radiation heat transfer from the furnace and the limited thermal conductivity of the helical flight often causes the tips of the helical flight to operate over the maximum desired operating temperature of the metal alloys forming the helical flight thereby leading to premature auger failure.

It will be appreciated that failure of the auger necessitates replacement of the auger and unwanted frequent downtime, high maintenance and labor costs, and inefficient use of the furnace which, in turn, leads to higher unit costs. In view of the foregoing, it will be appreciated that there is a significant need for an improved furnace discharge assembly.

An object of the present invention is to provide an improved furnace discharge assembly. Another object of the present invention is to provide a furnace discharge assembly including a discharge auger capable of better withstanding the high operating temperatures of a furnace. Yet another object of the present invention is to provide a furnace discharge assembly including a discharge auger and a fluid cooled hood to act as a heat sink to maintain the heat resistance of the metal alloy helical flights at an acceptable operating temperature. Still another object of the present invention is to provide a furnace discharge assembly that is simple and economical to manufacture and/or operate.

SUMMARY OF THE INVENTION

Briefly, according to this invention there is provided a discharge assembly for removing material from a hearth in a rotary hearth furnace. The discharge assembly includes, in combination, a discharge auger and a fluid cooled hood. The discharge auger is positioned above the hearth of the rotary hearth furnace and includes a central shaft having at least one helical flight affixed to the exterior of the central shaft. The fluid cooled hood is disposed over the discharge auger to lower the temperature of the helical flights.

BRIEF DESCRIPTION OF THE DRAWINGS

Further features and other objects and advantages of this invention will become clear from the following detailed description made with reference to the drawings in which.

DETAILED DESCRIPTION OF THE PREFERRED EMBODIMENTS

Figure 1:
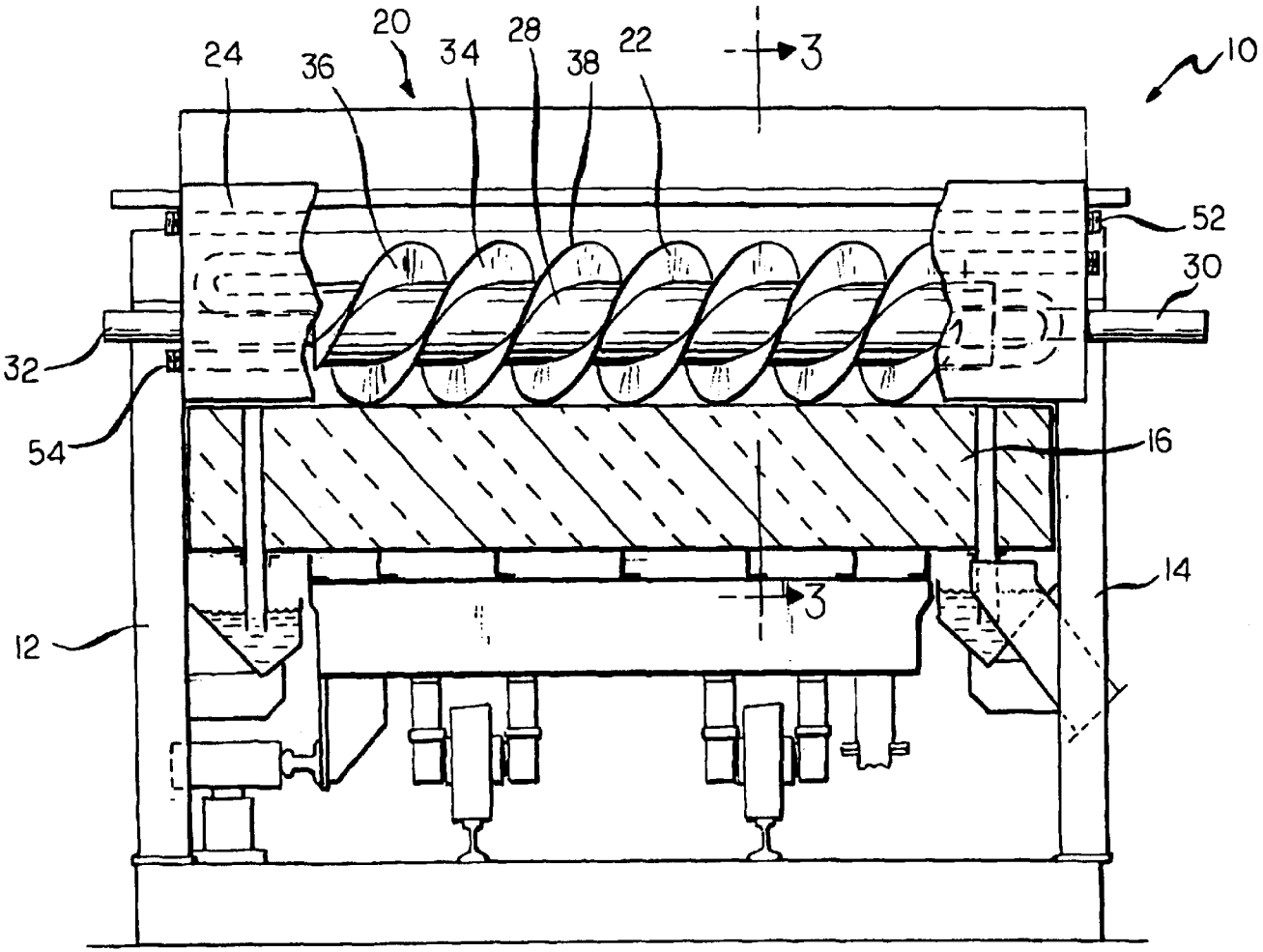
FIG. 1 is a partial sectional view of a furnace discharge assembly of a rotary hearth furnace including a discharge auger and a cooling hood.

In the following description, like reference characters designate like or corresponding parts. Referring to FIG. 1, a simplified cross-sectional view of a rotary hearth furnace (RHF) 10 is shown. In considering the RHF shown in FIG. 1, it must be realized that the structure is schematic only and that certain details of construction are well known in the art and not provided for purposes of clarity, It will also be understood that these construction details are, once the invention is disclosed and explained, well within the skill of the art.

As shown in FIG. 1, the RHF 10 includes an annular refractory insulated outer wall 12 and a spaced annular refractory insulated inner wall 14. A hearth 16 rotates within the RHF 10. A plurality of burners (not shown) are positioned about the RHF 10. Material is introduced onto the hearth 16 by a feeder mounted in the roof or through the outer wall (not shown) of the RHF 10 as well known in the art.

After material processing is complete, typically, after almost one complete rotation of the hearth 16, the material is removed by a discharge assembly 20 through a discharge port for subsequent treatment.

As shown in FIG. 1, the discharge assembly 20 of the RHF 10 includes a discharge auger 22 and a coolant hood 24. The discharge auger 22 is typically mounted about ¼–1 inch above the hearth 16 to remove substantially all of the material from the hearth. The hearth 16 is rotatably driven by a motor 26 operably connected to a mechanical linkage as well known in the art. The discharge auger 22 is mounted in a radial direction transverse to the path of the rotating hearth 16. In an alternate embodiment, the discharge auger 22 may be mounted at an angle skewed from radial to serve as a combination auger and plow for easier material removal from the rotating hearth.

The discharge auger 22 includes a central shaft 28 supported by two supporting end shafts 30 and 32 attached thereto. The central shaft 28 of the discharge auger 22 includes at least one helical flight 34. The helical flight 34 of the discharge auger 22 circumscribes the central shaft 28 and projects radially outward away from the central shaft. Each flight 34 extends from about 1–12 inches, preferably 6 inches, radially outward from the cylindrical shaft 28 and is about ¾–1.5 inches thick. The central shaft 28 may be insulated between flights to reduce heat loss as well known in the art.

An annular fluid passage 40 is formed within the central shaft 28 of the discharge auger 22 and within each attached supporting shaft 30 and 32 to provide fluid communication throughout the longitudinal extent of the discharge auger. In a preferred embodiment, the annular fluid passage 40 is formed between a core 42 provided within the central shaft 28 and the surrounding central shaft. A cooling fluid is supplied through the fluid passage 40 within the central shaft 28 and is distributed by a distributor plate 44 within the annular passage around the periphery of the core 42 and within the central shaft by distribution openings formed within the shaft. Fins 46 are attached to the internal core 42 and maintain the annulus spacing between the central shaft 28 and the core 42 and spiral the flowing cooling fluid around the annulus. The spiraling action increases the cooling fluid velocity and minimizes any tendency for non-uniform flow which may cause hot spots. The cooling fluid is gathered at the discharge distribution openings and is discharged out through the support shaft 32.

Figure 4:
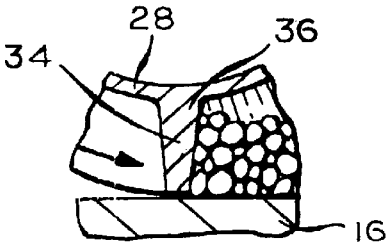
FIG. 4 is an enlarged partial view of the cross-section of a cast helical flight.
Figure 5:
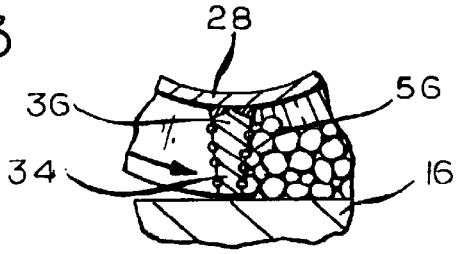
FIG. 5 is an enlarged partial view of the cross-section of a cast helical flight.
Figure 6:
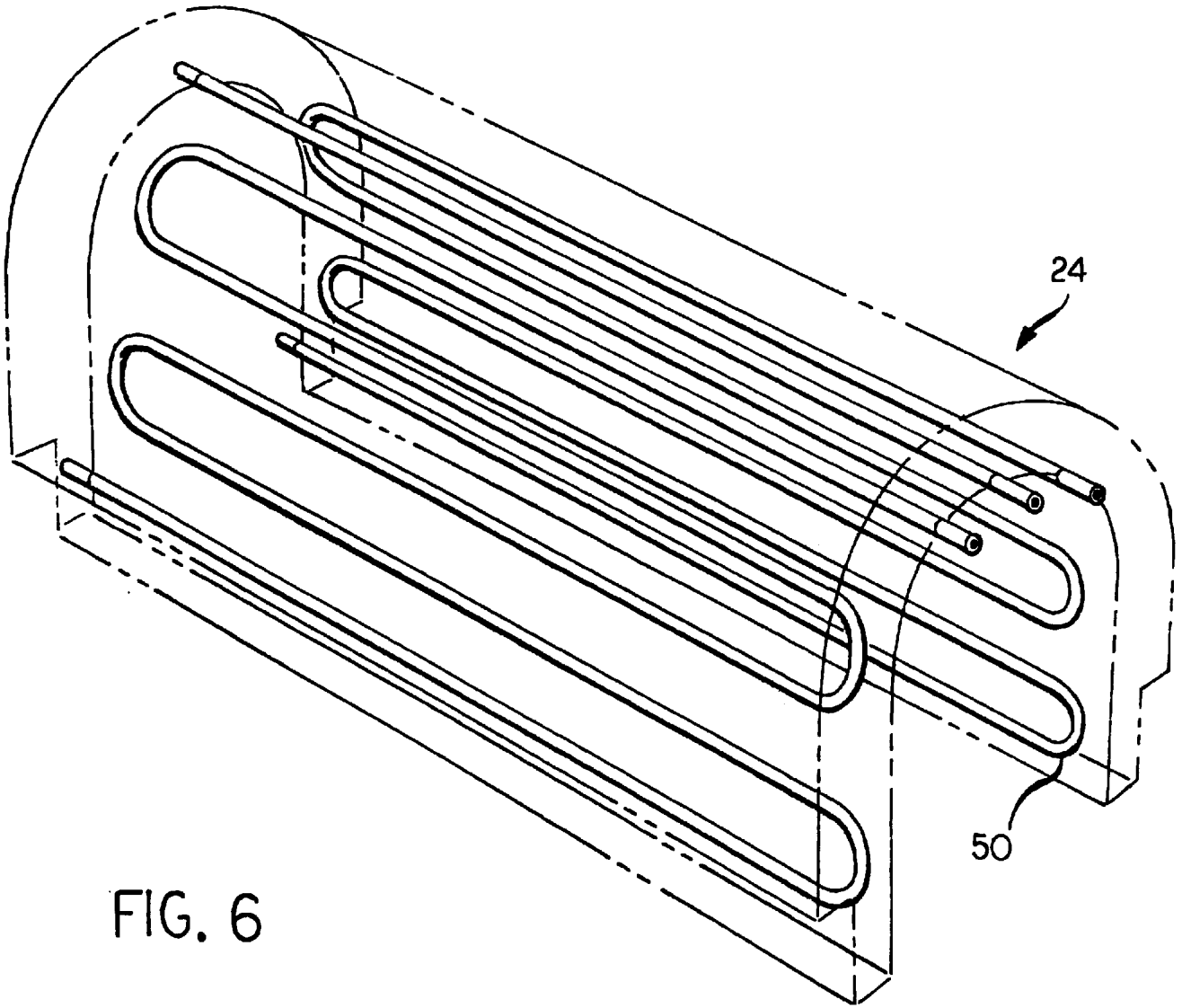
FIG. 6 is a phantom perspective view of the cooling hood of FIG. 1 which illustrates a serpentine pattern of the coolant sink.

Each helical flight 34 of the auger 22 includes a base 36 and a tip 38. The helical flight 34 may be made of most any suitable material such as a stainless steel alloy and the like. Suitable materials include wrought heat resistant stainless steels such as AISI Type 310 and AISI Type 330. The base 36 of each helical flight 34 may be welded to the outer surface of the central shaft 28 (FIG. 5) or the helical flights may be integrally cast with the central shaft 28 of the auger (FIG. 4). Suitable cast materials include heat-resistant stainless steel materials include ACI Type HK or ACI Type HT. For a more detailed description of cast heat-resistant stainless steels reference is made to Table 28–13 of Chemical Engineer's Handbook, 7th Edition, McGraw Hill, New York. An additional cast material is a super alloy such as sold under the name Supertherm, a casting material having a high carbon and high silicon content commercially available from Monoir Electroalloys. It will be appreciated that by casting the helical flight 34 on the outer surface of the central shaft 28 the cast material may be of a higher carbon and silicon content and tapered to reduce tip temperature.

Referring to the helical flight, the helical flight 34 may be formed as a solid member or the flight may be formed as a hollow member to permit cooling fluid to flow there through. The surfaces of the helical flight may include a wear resistant deposit 56 suitable for high temperature applications. For example, the surfaces of the helical flight may include a high hardness cobalt-chromium deposit such as that commercially available under the name Stellite 12-M, a cobalt alloy from Stoody. In a preferred embodiment, the helical flight 34 is tapered to improve heat conduction from the hearth to the flowing cooling fluid around the annulus. For a more detailed discussion of coolant flow to a helical flight reference is made to U.S. Pat. No. 4,636,127, incorporated herein by reference.

In a preferred embodiment, three flights may be formed about the central shaft 28. The helical flight 34 as shown is depicted in a clockwise right hand spiral. Accordingly, the discharge auger 22 as shown will rotate in a clockwise direction to remove material from the hearth 16.

The coolant fluid used in the present invention may be most any suitable fluid well known in the art such as water and the like.

It will be appreciated that the helical flights 34 of the discharge auger 22 receive heat from both the operating furnace and the material conveyed on the furnace hearth 16. The insulation typically applied over the central shaft limits radiation heat loss to the central shaft 28. Notwithstanding the presence of the insulation material, the high radiation heat flow from the operating furnace and the limited thermal conductivity of the alloy metal forming the flight 34, the tips 38 of the flight will often times operate over the maximum allowable operating temperature of the alloy metal. This causes limited life of the auger 22 and requires frequent replacement of the auger.

Figure 2:
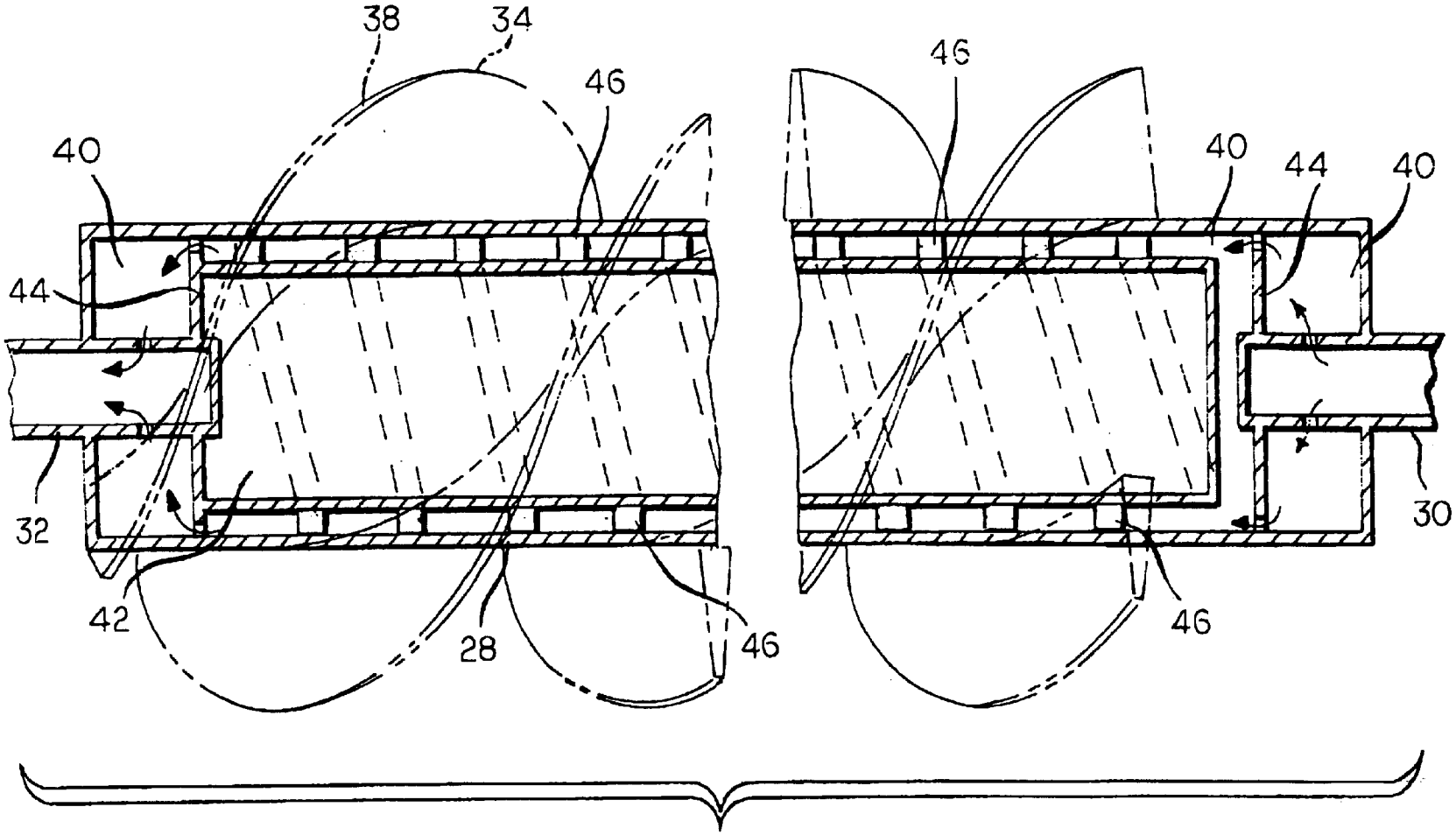
FIG. 2 is a sectional view of the auger of FIG. 1 showing the internal water passages.
Figure 3:
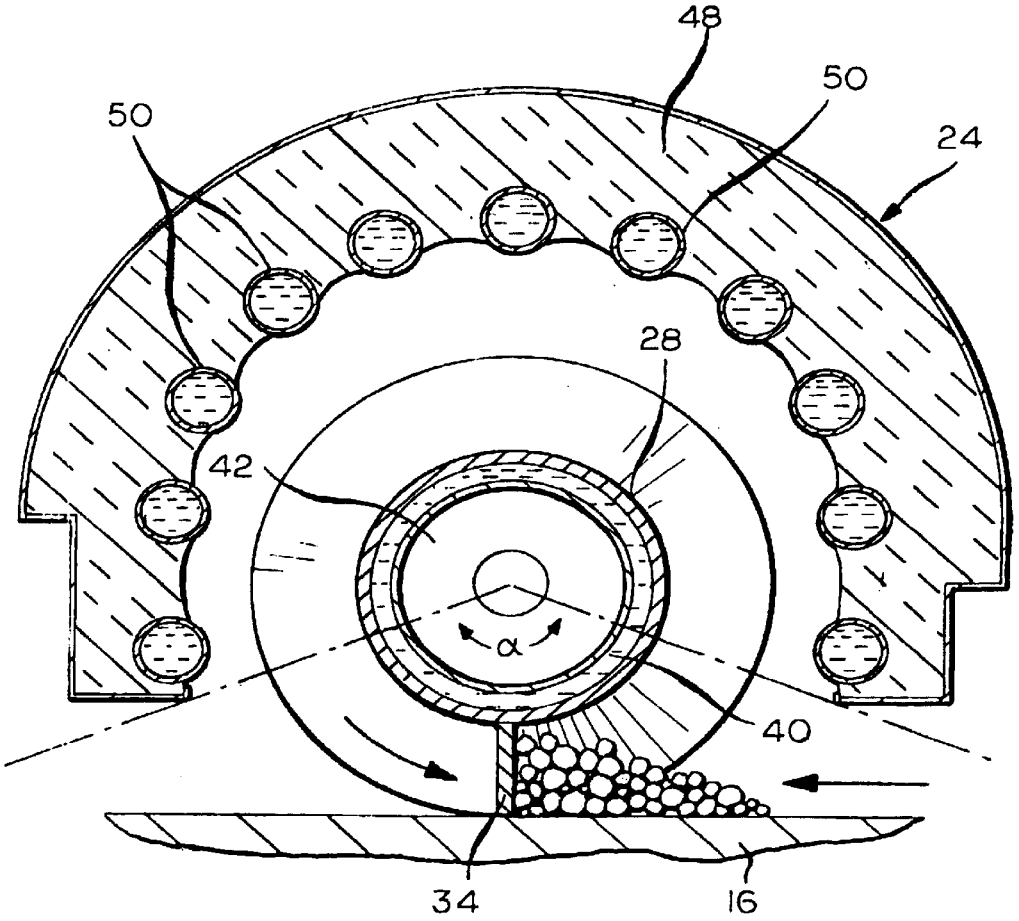
FIG. 3 is a cross-sectional view of the cooling hood of FIG. 1 taken along line 3—3.

As shown in FIGS. 2 and 3, a hood 24 is placed above the discharge auger. The hood 24 includes an insulated cover 48 and a coolant sink 50 along the interior surface of the cover. The coolant sink 50 is preferably attached to the interior surface of the cover. In a preferred embodiment, the coolant sink 50 includes a fluid filled tube formed in a serpentine pattern along the interior of the cover. A first end 52 of the tube is operably connected to a suitable fluid coolant source and an opposing second end 54 is operably connected to a reservoir wherein the fluid coolant is collected or subsequently disposed of. The fluid coolant flows through the tube in a continuous manner from end 52 to end 54 along the serpentine tube pattern.

The cover 48 and coolant sink 50 are of a size and shape to maximize the area of exposure of the tube to the helical flight 34 and reduce the exposure of the discharge auger 22 to the extreme temperatures of the operating furnace represented as solid angle $\alpha$ in FIG. 3. It will be appreciated that the greater the surface area of the interior of the hood 24 exposed to the helical flight 34, the greater the reduction in temperature of the flight tips 38. In a preferred embodiment, the hood 24 covers about 50% or more of the solid angle a around the discharge auger 22.

The invention will be further clarified by consideration of the following theoretical example, which is intended to be purely exemplary of certain aspects of the invention.

EXAMPLE

A theoretical reduction in temperature of the flight tips of an auger in view of heat radiation form a furnace was calculated based upon a rotary hearth furnace having a hearth width of about 7–8 feet and a furnace operating temperature of about 2300° F.

A base condition as indicated by (*) in Tables 1–3, is based upon the following assumptions: 38% of the surface area of the auger is exposed to the furnace heat, an auger with four (4) flights having a pitch of 24 inches, and a flight thickness of 34 inch. The emissivity of the flights is 0.70 and the cooled hood emissivity is 0.90. The outside diameter of the central shaft of the discharge screw is 18 inches and the wall thickness of the central shaft is ½ inch. A ½ inch thick insulation material surrounds the central shaft of the discharge screw to reduce heat loss. It is covered with a ¼ inch thick sheath with an emissivity of 0.70. The heat transferred to the helical flights is 77,078 Btu/hr-ft length. The heat transferred to the water cooled hood is 34,934 Btu/hr-ft length of the hood.

Table 1 shows the effect of varying the flight height, from the base condition (*), on the flight tip temperature.

TABLE 1

| Flight Height (inches) | Flight Tip Temperature (° F.) |
|---|---|
| 2 | 1559 |
| 4 | 1573 |
| 5 | 1621 |
| 6* | 1645* |
| 8 | 1667 |

Table 2 shows the effect of varying the flight thickness height, from the base condition (*), on the flight tip temperature.

TABLE 2

| Flight Thickness (inches) | Flight Tip Temperature (° F.) |
|---|---|
| 0.50 | 1670 |
| 0.75* | 1645* |
| 1.0 | 1627 |
| tapered - 1.0 (base) - 0.75 (tip) | 1638 |

Table 3 shows the effect of varying the furnace exposure to the auger, from the base condition (*), on the flight tip temperature.

TABLE 3

| Surface Area Exposed to Furnace (%) | Flight Tip Temperature (° F.) |
|---|---|
| 32 | 1554 |
| 38* | 1645* |
| 44 | 1731 |
| 50 | 1808 |
| 100 | 2236 |

As shown in the foregoing tables, if the flight thickness is increased from 0.50 inches to 1.0 inch the temperature of the flight tip will be reduced from 1670 degrees Fahrenheit to 1627 degrees Fahrenheit and if the surface area exposed to the furnace is reduced a reduction in flight tip temperature will also be realized. It is believed that the additional metal mass will conduct more heat to the water cooled surface thereby reducing the flight tip temperature. Furthermore, the 1 inch to 0.75 inch taper helical flight will conduct more heat away from the flight tip than a 0.75 inch thick straight helical flight.

The patents and documents identified herein are hereby incorporated by reference.

Having described presently preferred embodiments of the invention, it is to be understood that it may be otherwise embodied within the scope of the appended claims.

What is claimed is:

1. A discharge assembly for removing material from a hearth in a rotary hearth furnace comprising, in combination:

a discharge auger positioned above the hearth of the rotary hearth furnace, the discharge auger including a central shaft having at least one helical flight affixed to the exterior of the central shaft; and a hood disposed above the discharge auger, said hood including a cover and a coolant sink located along an interior surface of the hood to lower the temperature of the at least one helical flight.

2. The discharge assembly of claim 1 wherein the coolant sink is a fluid filled tube formed in a serpentine pattern along the interior of the cover.

3. The discharge assembly of claim 1 wherein the hood is an insulated cover.

4. The discharge assembly of claim 3 wherein the hood covers about 50% of the solid angle $\alpha$ around the discharge auger.

5. The discharge assembly of claim 4 wherein the discharge auger includes a central shaft supported by two supporting end shafts attached thereto, the central shaft having at least one helical flight attached thereto.

6. The discharge assembly of claim 5 wherein the central shaft is insulated between helical flights to reduce heat loss.

7. The discharge assembly of claim 6 further comprising a fluid passage formed within the central shaft and within each attached supporting shaft to provide fluid communication throughout the longitudinal extent of the discharge auger.

8. The discharge assembly of claim 7 further comprising a core member provided interior of the central shaft to define an annular fluid passage between the core member and the surrounding central shaft.

9. The discharge assembly of claim 8 further comprising fins attached to the core member to maintain the annulus spacing and spiral the flowing cooling fluid around the annulus.

10. The discharge assembly of claim 1 wherein each at least one helical flight includes a base and a tip, the base of each at least one helical flight welded to an outer surface of the central shaft.

11. The discharge assembly of claim 10 wherein the helical flight is formed as a solid piece.

12. The discharge assembly of claim 10 wherein the helical flight is formed as a hollow piece to permit cooling fluid to flow there through.

13. In combination with a rotary hearth furnace, a discharge auger assembly disposed therein, the discharge auger assembly including a discharge auger positioned above a hearth of the rotary hearth furnace, the discharge auger including a central shaft having at least one helical flight affixed to the exterior of the central shaft; and a hood disposed above the discharge auger, said hood including a cover and a coolant sink located along an interior surface of the hood to lower the temperature of the at least one helical flight.

14. The discharge assembly of claim 13 wherein the coolant sink is a fluid filled tube formed in a serpentine pattern along the interior of the cover.

15. The discharge assembly of claim 14 wherein the hood is an insulated cover.

16. The discharge assembly of claim 15 wherein the hood covers about 50% of the solid angle $\alpha$ around the discharge auger.

17. The discharge assembly of claim 16 wherein the discharge auger includes a central shaft supported by two end supporting shafts attached thereto, the central shaft having at least one helical flight attached thereto.

18. The discharge assembly of claim 17 wherein the central shaft is insulated between helical flights to reduce heat loss.

19. The discharge assembly of claim 13 further comprising a fluid passage formed within the central shaft and within each attached supporting shaft to provide fluid communication throughout the longitudinal extent of the discharge auger.

20. The discharge assembly of claim 19 further comprising a core member provided interior of the central shaft to define an annular fluid passage between the core member and the surrounding central shaft.

* * * * *